United States Patent [19]

Wilson

[11] 4,199,965

[45] Apr. 29, 1980

[54] YARN FEED CONTROL SYSTEM

[75] Inventor: Peter Wilson, Redhill, England

[73] Assignee: Aktiebolaget IRO, Ulricehamn, Sweden

[21] Appl. No.: 824,702

[22] Filed: Aug. 15, 1977

[30] Foreign Application Priority Data

Aug. 16, 1976 [GB] United Kingdom ..... 34031/76

[51] Int. Cl.[2] ..... D04B 15/48

[52] U.S. Cl. ..... 66/125 R

[58] Field of Search ..... 66/125 R; 364/470; 66/54, 146, 132 T, 132 R

[56] References Cited

U.S. PATENT DOCUMENTS

| | | | |
|---|---|---|---|
| 2,949,756 | 8/1960 | Curtis | 66/132 R |
| 3,225,570 | 12/1965 | Mishcon | 66/132 T |
| 3,408,500 | 10/1968 | Carr | 66/125 R |
| 3,566,134 | 2/1971 | Peat | 66/125 R |
| 3,670,527 | 6/1972 | Bourgeois | 66/50 R |
| 3,677,036 | 7/1972 | Hatay | 66/125 R |
| 3,690,123 | 9/1972 | Delair et al. | 66/125 R |
| 3,858,415 | 1/1975 | Wilson et al. | 66/125 R X |
| 3,858,416 | 1/1975 | White et al. | 66/146 X |
| 3,961,500 | 6/1976 | Braley et al. | 364/470 |
| 3,970,014 | 7/1976 | Chano et al. | 112/121.11 |
| 3,996,772 | 12/1976 | Gottschall et al. | 66/50 |

FOREIGN PATENT DOCUMENTS

| | | | |
|---|---|---|---|
| 2126778 | 12/1972 | Fed. Rep. of Germany | 66/125 R |
| 7120254 | 4/1973 | France | 66/132 R |

*Primary Examiner*—Thomas F. Callaghan
*Assistant Examiner*—Andrew M. Falik
*Attorney, Agent, or Firm*—Blanchard, Flynn, Thiel, Boutell & Tanis

[57] ABSTRACT

A method and apparatus for feeding yarn to a knitting machine having needle selecting means so that the length of yarn required to be knitted into each sequence of a small number of stitches is not constant. The length of yarn as actually fed to the knitting machine during each sequence of a small number of stitches is measured, and a value or signal representing the actual measured length of yarn is then compared to a predetermined length value which represents or is a function of a predetermined stitch length. The tension in the yarn as fed to the knitting machine is continuously adjusted in response to deviations or differences detected by the comparison of the predetermined and measured length values.

15 Claims, 9 Drawing Figures

YARN FEED CONTROL SYSTEM

FIELD OF THE INVENTION

This invention relates to methods and apparatus for knitting machine control systems and, more specifically, to the sensing of the actual yarn tension and the adjusting thereof to permit proper yarn consumption.

BACKGROUND OF THE INVENTION

It is known to use control devices for knitting machines which, in order to control the length of yarn used by a knitting machine, each feeder receives yarn from a yarn feeding means which feeds yarn to it at a rate which is fixed at a value proportional to the knitting machine speed. Such yarn feeding devices commonly consist of a nip roller drive coupled to a driven part of the knitting machine and are suitable only when the required length of yarn to be knitted into each sequence of a small number of stitches is substantially constant.

When a knitting machine is fitted with needle selecting means so that the length of yarn required to be knitted into each sequence of a small number of stitches is not substantially constant the known arrangements described above are not suitable as the individual feeding devices cannot readily provide the various lengths of yarn which are required to be fed into the knitting machine at different times during the knitting. The present invention is believed to represent a solution to this problem.

According to one aspect of the present invention, there is provided a method of feeding yarn to a knitting machine having a group of yarn feeders and also having needle selecting means so that the length of yarn required to be knitted into each sequence of a small number of stitches is not constant, each individual yarn being fed to the knitting machine at an adjustable tension by one of the yarn feeders, the method including the steps of:

(1) measuring the length of an individual yarn fed to the knitting machine during each sequence of a small number of stitches;

(2) comparing the measured length to a predetermined length value which is a function of a predetermined stitch length;

(3) adjusting the tension in said individual yarn fed to the knitting machine in response to any deviation detected in comparison step (2) above; and (4) maintaining the adjusted tension while repeating steps (1) and (2) and then repeating step (3) in response to the deviation detected during the repetition of steps (1) and (2) so as to continuously adjust the tension of said yarn fed to the knitting machine so that the actual yarn consumption in the knitting of an article is substantially equal to the predetermined yarn consumption.

Advantageously the function of said stitch length which is measured is the length of yarn being knitted.

The length of yarn being knitted can be measured in a number of ways. For example, the yarn may pass around a rotatable member and be arranged to make non-slipping contact therewith so that the length of yarn being knitted can be measured from the speed of rotation of the member. If desired, the member can be one of a pair of nip rollers.

In order to adjust the tension in the yarn fed to the knitting machine, a yarn-driven rotatable member may be employed, the tension being adjusted by controlling the resistance to rotation of the rotatable member. Again, if desired, the rotatable member may be one of a pair of nip rollers.

The tension control may be effected using a feed mechanism for the yarn which is driven by means of a tape drive. Preferably, the error detected by the comparing means is used to set a tension value and the feed mechanism is arranged to introduce the set tension into the yarn.

According to a further aspect of the present invention an apparatus for controlling the feeding of yarn to a knitting machine comprises means for measuring the stitch length of yarn which has been knitted by said machine or a function of said stitch length, means for comparing said measured stitch length or function thereof with a predetermined stitch length or comparable function thereof and means for adjusting the tension in the yarn fed to the knitting machine in response to any error detected by the comparing means.

For the purpose of carrying out the invention to control the length of yarn knitted by a knitting machine the means for determining the length of yarn LM1 being knitted by the machine may for example, be a rotating member with the circumferential surface of which the yarn makes non-slipping contact before it passes into the feeder of the knitting machine. The circumferential speed of the rotating member is thus equal to the speed of the yarn. It will be understood that the rotating member may for example conveniently be part of the adjusting means described above.

The rotation of the member as the yarn passes over it may conveniently be sensed by displacement detecting means which produces an output signal which is a measure of the length of yarn passing into the knitting machine. The displacement detecting means may conveniently be photoelectric, magnetic capacitative or pneumatic and the output signal may conveniently be in digital or analogue form and may conveniently take the form of an electrical current or voltage suitable for transmission to another location.

For the purpose of carrying out the invention to control the length of yarn being knitted by a knitting machine which has needle selecting means in operation controlled by a stored program computer, the means for producing a control signal to control the adjusting means, this control signal being related to the departure of the length of yarn knitted by the knitting machine from the required length, may be, for example, a transducer giving an output signal suitable for the control of the adjusting means in response to an electrical input signal produced by the computer. The computer may be programmed to calculate the required length to be knitted during each convenient amount of knitting displacement of the knitting machine from data supplied in the computer program. The computer may be arranged to receive the signal referred to above and to compute the departure from the required length of the length of yarn knitted by the knitting machine for each convenient amount of knitting displacement of the knitting machine and to produce the corresponding signal for the transducer which correspondingly produces the control signal for the adjusting means.

In order to control the length of yarn knitted by a knitting machine which has needle selecting means in operation controlled by electrical signals derived from a pattern data storage device, which may be for example a digitally marked film strip or a digitally encoded magnetic tape or a digitally perforated tape, the means for producing a signal to control the adjusting means is related to the departure of the length of yarn knitted by the knitting machine from the required length and may be for example a transducer giving an output signal suitable for the control of the adjusting means in response to an electrical input signal produced by for example a stored program computer provided with access to the needle selecting signals with the knitting machine. The computer may be programmed to calculate the required length of yarn to be knitted during each convenient amount of knitting displacement of the knitting machine from data supplied in the computer program. The computer may be arranged to compute the departure from the required length of the length of yarn knitted by the knitting machine for each convenient amount of knitting displacement of the knitting machine and to produce the corresponding signal for the transducer which correspondingly produces the control signal for the adjusting means.

DETAILED DESCRIPTION

Figure 1:
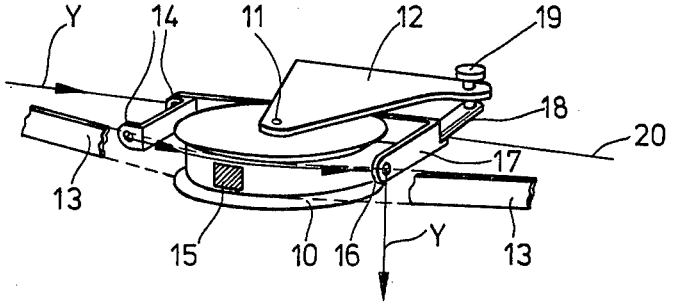
FIG. 1 is a diagrammatic perspective view of one form of tensioning means for use in accordance with the present invention.

FIG. 1 shows one form of tensioning device which may be employed so that the actual thread length as consumed by the knitting machine equals a predetermined value. This tensioning device comprises a rotatable roller 10 pivoted at 11 to a supporting plate 12 and arranged to be rotated by a driving tape 13. The yarn Y passes through a pair of yarn guides 14 and contacts the rotatable member 10 at a nip region 15 and passes out to a feeder of an associated knitting machine via a yarn guide 16.

The yarn guides 14 and 16 are mounted on a supporting arm 17 of generally U-shape, the arm 17 being pivoted at a position not shown, about a pivot axis 20. The arm is connected via a flat spring 18 to an adjusting screw 19 mounted in the plate 12.

The yarn Y is fed to first guide 14 axially with respect to pivot axis 20 so that the tension in the yarn Y does not apply a turning moment to the arm 17. The yarn Y leaves guide 16 in a vertical path so that the tension in the yarn Y does apply a turning moment about pivot axis 20, the moment being opposed by the restoring force of spring 18.

The restoring force applied by spring 18 is set by means of the adjusting screw 19 which is set to provide a set tension in response to the error detected by the comparing means. Thus when the tension in yarn Y exceeds the set value the arm 17 is deflected about pivot axis 20 to move the yarn Y from the nip region 15 and when the tension falls below the set value the yarn Y is returned to the nip region 15 by the action of the spring 18 on the arm 17.

Such a device is suitable for adjusting the tension of the yarn being fed to a feeder of the knitting machine.

Figure 2:
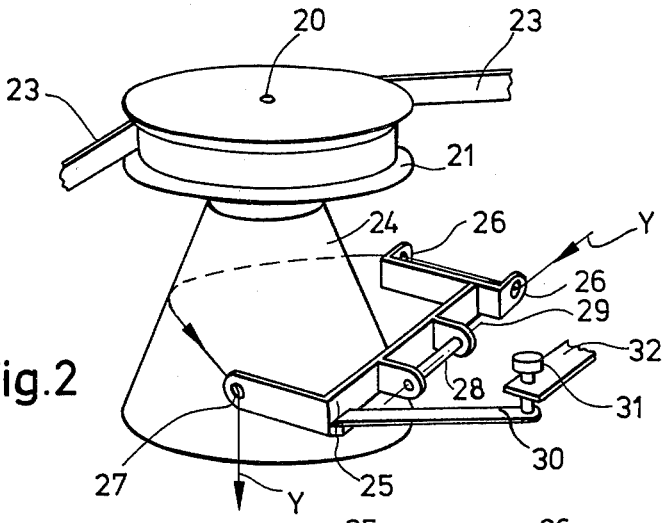
FIG. 2 is a diagrammatic perspective view of an alternative form of tensioning means.

An alternative form of tensioning device is shown in FIG. 2. This device employs a similar rotatable member 21 mounted for rotation about an axis 20 and adapted to be driven by a tape 23. Mounted coaxially with the member 21 and adapted for rotation therewith is a conical capstan 24, the yarn Y being wrapped around a part of the conical surface. In order to enhance the frictional contact, the capstan may be provided with a friction surface, for example, an emery coating.

The generally U-shaped arm 25, similar to the arm 17 described in relation to FIG. 1, includes a first pair of yarn guides 26 and a yarn guide 27. The arm 25 is pivoted at 28 about a pivot axis 29 and carries a flat spring 30 which contacts the adjusting screw 31 carried by a supporting plate 32. The yarn Y extends from a yarn supply to the first yarn guide 26 in alignment with the pivot axis, passes through the second guide 26 around the surface of the capstan 24 and emerges through guide 27 to be delivered to the feeder of the knitting machine.

It will be appreciated that the rate of feed of the yarn will depend upon the circumferential surface speed of the capstan at the axial position of the yarn which in turn is determined by the position of the guides 26 and 27. Such a device is suitable for controlling the length and thus the tension of yarn supplied to a feeder of a knitting machine per unit displacement of the knitting machine.

Figure 3:
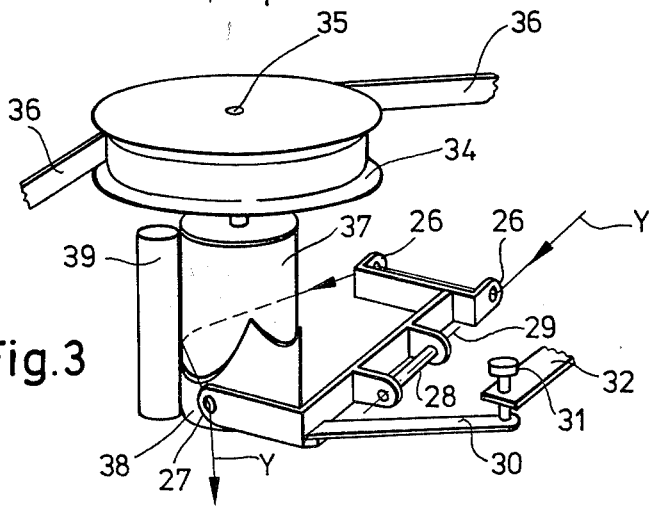
FIG. 3 is a diagrammatic perspective view of a further alternative tensioning means.

A further alternative tensioning device is shown in FIG. 3 which comprises a similar rotatable member 34 pivoted for rotation about an axis 35 and adapted to be driven by means of a tape 36. Mounted coaxially with said rotatable member and adapted for rotation therewith is a roller 37 having a profiled rubber covering 38 and a nip roller 39 which may have a surface of a relatively hard material such as steel. The yarn guides shown in FIG. 3 are similar to those shown in FIG. 2 and similar reference numerals have been used in the drawing.

The yarn Y is delivered to the guide 26 along the pivot axis 29, passes around the profiled rubber covered roller 37, between the nip of rollers 37 and 39 and is delivered via the guide 27. As in the case of the tensioning device shown in FIG. 2, the axial position at which the yarn Y contacts the rubber covering 38 will depend upon the position of guides 26 and 27 and by suitable adjustment the value of the length and thus the tension of yarn supplied to a feeder of a knitting machine per unit displacement of the knitting machine can be controlled.

Figure 4:
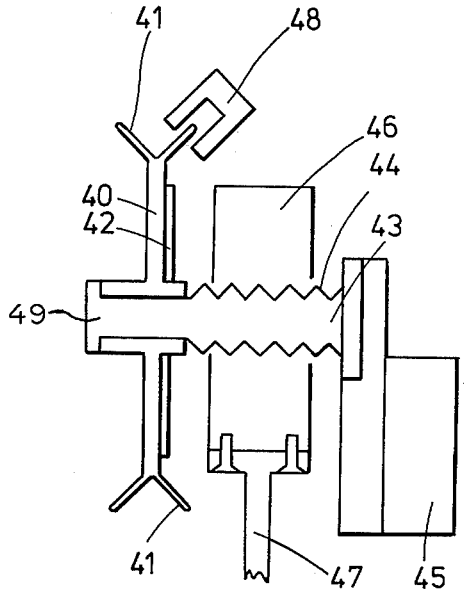
FIG. 4 is a schematic diagram of an error-controlled brake-measuring pulley.

Referring to FIG. 4 a device is shown which can function both as a yarn tensioning device and as a measuring device for measuring the length of the yarn being knitted.

The device comprises a rotatable disc 40 having flanges 41 and which carries a disc 42, for example, of aluminum. The disc 40 rotates about a shaft 43 which is screw-threaded over part of its length on which is carried a magnet 46 which is prevented from rotating by a mounting 47. The shaft 43 can be rotated by the action of the coupled geared motor 45 so as to move the magnet 46 closer to the disc 40 to increase the hysteresis braking effect or vice versa. The yarn contacts the flange portion of the rotatable member 40 and control can then be applied thereto by means of hysteresis braking induced by the effect of the magnet 46 on the disc 42, the braking depending on the axial position of magnet 46 which is controlled in response to a comparison error signal derived from the desired stitch length and the measured yarn length.

In order that the device can operate also as a measuring pulley, a sensor 48 is disposed about one flange 41 of the rotatable member 40. This sensor can detect the speed of rotation of the rotatable member, and providing that the yarn is in non-slipping contact with the surface thereof, the length of yarn delivered per unit displacement of the knitting machine can be derived.

Figure 5:
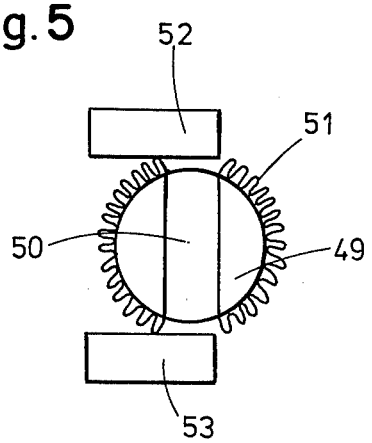
FIG. 5 is a diagram on an enlarged scale of a sensor for use on the hub of a pulley of the device shown in FIG. 4.

It is preferable to employ a sensor which acts on the hub 49 of the rotatable member since the diameter is preferably small to reduce the torque induced by cleaning pads which are employed. Such a sensor is shown diagrammatically in FIG. 5 of the drawings in which the hub 49 is provided with a diametrical hole 50 and a pile fabric covering 51 which serves as a cleaning pad. A photoelectric cell 52 is disposed diametrically opposite a light emitting diode 53 so that when the diametrical hole 50 is in alignment between the cell 52 and the diode 53 a pulse is produced. It will be appreciated that the device provides two pulses per revolution and the provision of the pile fabric produces a surface to provide a continuous cleaning effect between pulses.

Figure 6:
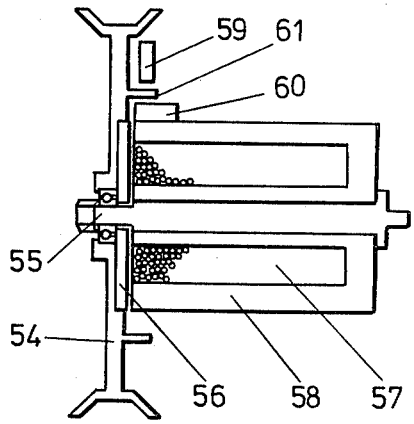
FIG. 6 is a diagrammatic cross section of an alternative error-controlled brake/measuring pulley.

Another form of combined error-controlled brake and measuring device is shown in FIG. 6. This utilizes a rotatable member, around which the yarn passes, in the form of a capstan 54 arranged to rotate about an axis 55. The capstan may, for example, be made from a suitable plastics material and carries a disc 56, for example, of aluminum. An electromagnetic coil 57 is mounted coaxially with said disc, the coils being wound on electromagnet 58. This arrangement functions in a manner similar to that shown in FIG. 4 with the exception that the photoelectric cell 59 and the light emitting diode 60 are disposed on each side of an apertured flange 61 and the hysteresis braking effect is adjusted by varying the electromagnet energizing current. The number of apertures in the flange 61 will of course determine the number of pulses produced per revolution of the capstan.

Figure 7:
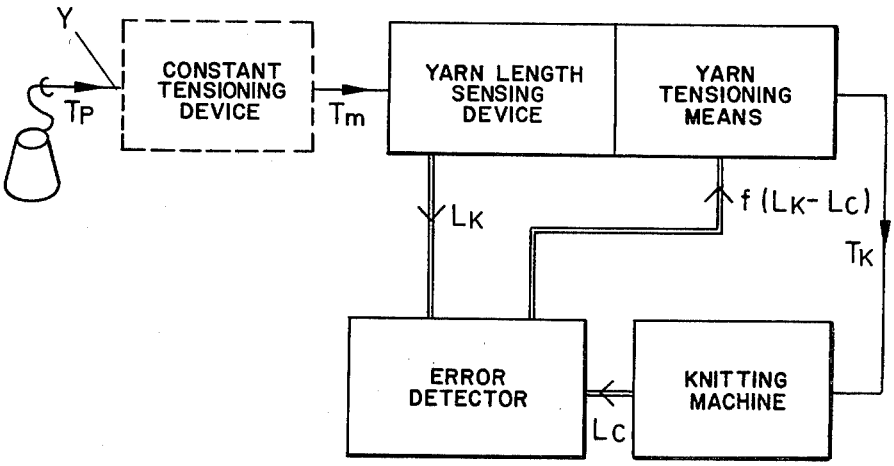
FIG. 7 is a schematic block diagram illustrating the operation of the present invention.

FIG. 7 is a block diagram showing an arrangement according to the invention connected to a knitting machine. A supply of yarn Y is fed at an off-winding tension $T_P$ to a constant tensioning device and is then passed to a yarn length sensing device at a tension $T_M$. The yarn then passes to an adjustable yarn tensioning means and is delivered at a knitting tension $T_K$ to the feeder of a knitting machine. A signal $L_C$ representing the desired stitch length or a function thereof is derived from the knitting machine and fed to the error detector (i.e., comparator) together with a signal $L_K$ representing the actual yarn length measurement from the yarn length sensing device, and the difference or error $f(L_K-L_C)$ is supplied to the yarn tensioning means whereby the appropriate adjusted knitting tension $T_K$ is induced in the yarn fed to the knitting machine so as to correct for this error.

Figure 8:
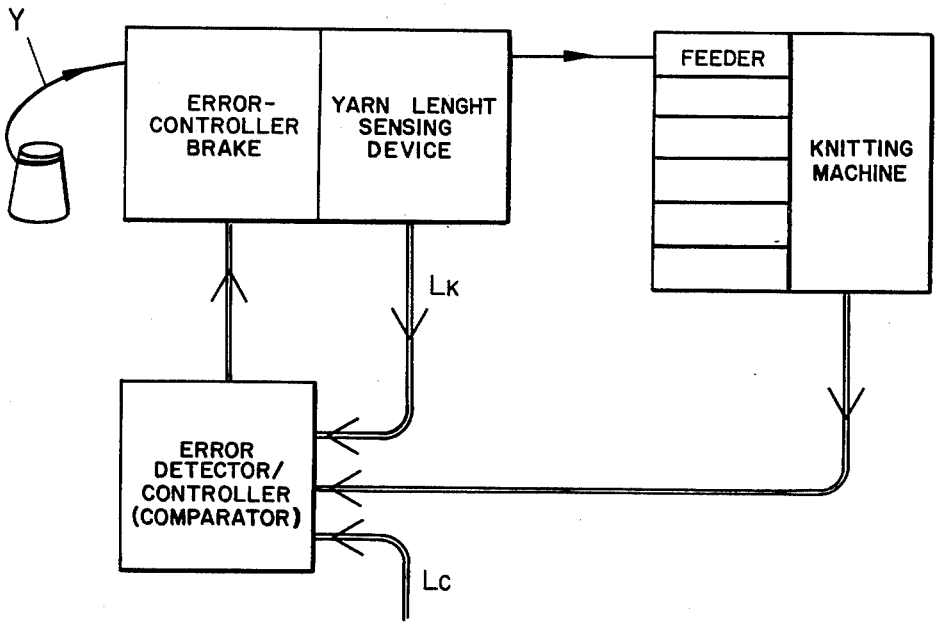
FIG. 8 is a block diagram of an apparatus employing a comparison error-controlled brake.

An alternative arrangement is shown in FIG. 8 in which case the yarn length sensing device is part of a length sensor/error-controlled brake such as that shown in FIG. 4 or 6. As can be seen the yarn Y is fed from the yarn supply package to the brake/sensor and the yarn with the appropriate tension is fed to one feeder of the group associated with the knitting machine. A needle selection signal is derived from the knitting machine and fed to an error-detector/controller in conjunction with a knitted length signal $L_K$ derived from the length sensing device and an input $L_C$ representing the desired stitch length. The comparator/controller then produces a control signal which is fed to the error-controlled brake which applies the appropriate adjusted tension to the yarn.

The comparator/controller may be of many conventional constructions, one such construction being a bridge circuit which compares voltage signals, as disclosed in U.S. Pat. No. 3,858,416, White et al, Column 4, lines 33–41.

Figure 9:
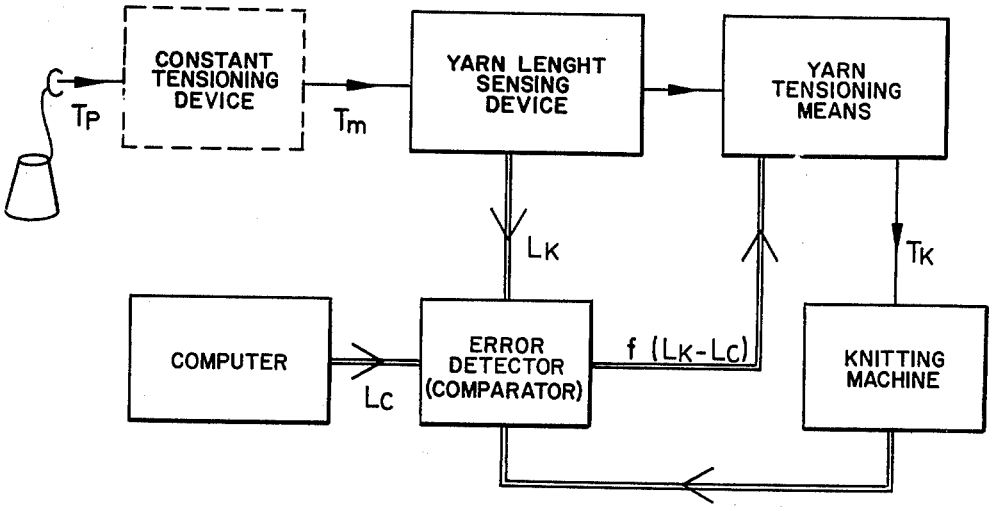
FIG. 9 is a block diagram of an apparatus for use in conjunction with a computer controlled knitting machine.

When computer controlled knitting machines are employed then the computer may itself be used to provide an output for use in the error detector or comparator. Such an arrangement is shown in FIG. 9 where the yarn under a tension $T_P$ is fed to a constant tensioning device from which it emerges at a tension $T_M$. A yarn length sensing device and yarn tensioning device then deliver the yarn at a knitting tension $T_K$ to the feeder of the knitting machine. Information from the knitting machine such as a needle selection signal is fed to the error detector in conjunction with computer information $L_C$ and a signal representing the measured length of yarn $L_K$ and an error signal $f(L_K-L_C)$ is fed to the yarn tensioning device so as to adjust the yarn tension whereby the measured yarn length will equal the desired yarn length.

In this invention, use may be made of the characteristic of many patterned knitted fabrics that one course is knitted by a group of feeders in such a way that each needle in a selectable set of the knitting machine is selected to knit at one and only at one feeder of the group in each widthway repeat of the pattern. In such cases the total length of yarn required to be knitted by the group of feeders for an integral number of widthway pattern repeats is substantially constant and independent of the patterning and may conveniently be calculated before knitting begins. Accordingly, the control of the length of yarn knitted by a knitting machine with the needle selecting means in operation may be accomplished, for example, by providing means for producing a signal to control the adjusting means comprising, for example, a comparator which accepts the signal which is related to the length of yarn knitted by the machine during each integral number of widthway pattern repeats at each feeder in the group and compares the sum for the feeders in the group of these signals with a predetermined value representing the required total length for the feeder group for each integral number of widthway pattern repeats and produces an output signal related to the difference between them and suitable for the control of the adjusting means in use of all the feeders in the group severally and in concert at a common setting. Means may be provided for providing a gating signal to start and stop the length measuring functions of means LM1 at the beginning and end respectively of the knitting of the required integral number of widthway pattern repeats.

What I claim is:

1. A method of feeding yarns to a knitting machine having a group of yarn feeders and also having needle selecting means so that the length of yarn required to be knitted into each sequence of a small number of stitches is not constant, wherein one or more of the feeders requires a different and varying yarn feed rate from the other feeders in said group the individual yarns being fed to the knitting machine at an adjustable tension by the yarn feeders, comprising the steps of:

(1) measuring the length of an individual yarn fed to the knitting machine during each sequence of a small number of stitches;

(2) comparing the measured length to a pedetermined length value which is a function of a predetermined stitch length;

(3) adjusting the tension in said individual yarn fed to said knitting machine in response to any deviation detected in comparison step (2) above; and (4) maintaining said adjusted tension while repeating steps (1) and (2) and then repeating step (3) in response to the deviation detected during the repetition of steps (1) and (2) so as to continuously adjust the tension of said yarn fed to the knitting machine so that the actual yarn consumption in the knitting of an article is substantially equal to the predetermined yarn consumption.

2. A method according to claim 1, wherein the predetermined length value is provided by a computer which controls the knitting machine.

3. A method according to claim 1, including the steps of controlling the stitch pattern of the knitting machine by means of a predetermined pattern and predetermined stitch length as provided by a computer, said predetermined length value being provided by the computer based upon the stored predetermined stitch length.

4. A method according to claim 3, wherein the predetermined length value as supplied by the computer indicates the theoretical total length of yarn required by the group of yarn feeders associated with the knitting machine for knitting each pattern cycle, and wherein the measured length value indicates the total yarn consumption of the group of yarn feeders during each said pattern cycle.

5. A method according to claim 1, including the steps of adjusting the individual tension in the yarn by guiding the yarn around a rotatable part and controlling the resistance to rotation of said part.

6. A method according to claim 1, wherein the length of yarn fed to the knitting machine is measured by a device which at the same time also controls the tension of the yarn.

7. A method of feeding a plurality of yarns to a knitting machine for knitting an article having stitches of predetermined size while consuming only a predetermined quantity of yarn, the yarns being fed to the knitting machine at an adjustable tension by a group of feeding devices, and said knitting machine having needle selecting means so that the lengths of the yarns required to be knitted during each predetermined displacement of the knitting machine is not constant, wherein one of more of the feeding devices requires a different and varying yarn feed rate from the other feeding devices in said group comprising the steps of:

(1) measuring the length of an individual yarn fed to the knitting machine during the predetermined displacement of the knitting machine;

(2) comparing the measured length to a predetermined size value which represents or is a function of the predetermined stitch size;

(3) adjusting the tension in said individual yarn fed to said knitting machine in response to any deviation detected in comparison step (2) above; and (4) maintaining said adjusted tension while repeating steps (1) and (2) and then repeating step (3) in response to the deviation detected during the repetition of steps (1) and (2) so as to continuously adjust the tension of said individual yarn fed into the knitting machine so that the actual yarn consumption in the knitting of said article is substantially equal to said predetermined quantity.

8. A method according to claim 7, including the steps of controlling the stitch pattern of the knitting machine by means of a predetermined pattern and predetermined stitch length as provided by a computer, said predetermined size value being provided by the computer based upon the stored predetermined stitch length.

9. In combination with a knitting machine having needle selecting means so that the length of yarn required to be knitted into each sequence of a small number of stitches is not constant, a group of controlled yarn feeders each for feeding an individual yarn to said knitting machine for knitting an article having stitches of predetermined length while consuming only a predetermined quantity of yarn, wherein one or more of the feeders requires a different and varying yarn feed rate from the other feeders in said group said feeder comprising:

means for measuring the length of said yarn fed to the knitting machine during each sequence of a small number of stitches;

means for comparing the measured length to a predetermined length value which represents or is a function of said predetermined stitch length; and means for continuously adjusting the tension in said yarn fed to said knitting machine in response to any deviation or difference detected by said comparing means.

10. A device according to claim 9, wherein a computer is provided for controlling the knitting machine, said computer having means for supplying said predetermined length value.

11. A device according to claim 10, wherein said computer provides a predetermined stitch length and a predetermined stitch pattern for controlling the knitting machine and for providing said predetermined length value as a function of said predetermined stitch length.

12. A device according to claim 11, wherein said computer provides a signal representing the predetermined length value which indicates the theoretical total length of yarn required by the group of yarn feeders for each pattern cycle, and the measured length value comprising a signal indicating the total yarn consumption of the group of yarn feeders during each pattern cycle.

13. A device according to claim 9, wherein the tension adjusting means includes a rotatable part around which the yarn is guided, and means for controlling the resistance to rotation of said part to thereby control the tension in said yarn.

14. A device according to claim 9, wherein the measuring means and the tension adjusting means comprise the same device.

15. A method of feeding yarn to a knitting machine having needle selecting means so that the length of yarn required to be knitted into each sequence of a small number of stitches is not constant, the yarn being fed to the knitting machine at an adjustable tension by a yarn feeder, comprising the steps of:

(1) measuring the length of yarn fed to the knitting machine during each sequence of a small number of stitches;

(2) providing a first signal which represents the measured length of yarn;

(3) providing a second signal which is derived from the knitting machine and represents the specific needle selection;

(4) providing a third signal which represents a predetermined yarn length value which is a function of a predetermined stitch length;

(5) comparing the signals measured by steps (2), (3) and (4) above;

(6) providing a control signal responsive to any deviation detected in comparison step (5) above;

(7) adjusting the tension in said yarn fed to the knitting machine in response to the control signal as provided by step (6) above; and (8) maintaining said adjusted yarn tension while repeating steps (2) through (4) and then repeating steps (6) and (7) in response to the control signal provided by the repetition of step (5) so as to continuously adjust the tension of said yarn fed to the knitting machine so that the actual yarn consumption in the knitting of an article is substantially equal to a predetermined yarn consumption.

* * * * *

UNITED STATES PATENT AND TRADEMARK OFFICE

CERTIFICATE OF CORRECTION

PATENT NO. : 4 199 965

DATED : April 29, 1980

INVENTOR(S) : Peter Wilson

It is certified that error appears in the above—identified patent and that said Letters Patent is hereby corrected as shown below:

Column 7, line 5; insert a comma (,) after "group".

Column 7, line 11; change "pedetermined" to ---predetermined---.

Column 7, line 44; delete "individual" before the word "tension", and insert ---individual--- before "yarn".

Column 7, line 60; change "of" (first occurrence) to ---or---.

Column 7, line 62; insert a comma (,) after "group".

Column 8, line 27; insert a comma (,) after "group".

Signed and Sealed this

*Second* Day of *September 1980*

[SEAL]

*Attest:*

SIDNEY A. DIAMOND

*Attesting Officer*

*Commissioner of Patents and Trademarks*